US005213316A

United States Patent [19]

Loebach

[11] Patent Number: 5,213,316

[45] Date of Patent: May 25, 1993

[54] SHEET HANDLING APPARATUS WITH AIR DEFLECTOR

[76] Inventor: Michael B. Loebach, N2577 Highway D, Ft. Atkinson, Wis. 53538

[21] Appl. No.: 785,186

[22] Filed: Oct. 31, 1991

Related U.S. Application Data

[63] Continuation of Ser. No. 603,138, Oct. 24, 1990, abandoned.

[51] Int. Cl.[5] ..... B42C 1/00; B31F 1/08

[52] U.S. Cl. ..... 270/47; 493/424; 493/428; 493/432

[58] Field of Search ..... 270/13, 14, 15, 47, 270/48, 49, 50, 60; 493/424, 425, 426, 427, 428, 429, 432, 454

[56] References Cited

U.S. PATENT DOCUMENTS 1,853,320 4/1932 Roesen ..... 270/60

2,335,431 11/1943 Meyer ..... 493/429

4,378,263 3/1983 Lehmacher ..... 270/47

*Primary Examiner*—Edward K. Look

*Assistant Examiner*—John Ryznic

*Attorney, Agent, or Firm*—Reed Smith Shaw & McClay

[57] ABSTRACT

A method and apparatus for reducing the formation of "dog-ears" or folded corners in material handled by sheet material handling machines such as folders for printing presses in which material such as paper is secured to a rotating cylinder near a leading edge, which includes providing a projection on the cylinder which deflects air flow away from the material leading edge so as to reduce the tendency for the material to lift from the cylinder. In order to pass through the cylinder nip, the projection may be constructed of compressible resilient material such as foam rubber or may be deflectable upon contact with an opposing cylinder.

41 Claims, 2 Drawing Sheets

SHEET HANDLING APPARATUS WITH AIR DEFLECTOR

This application is a continuation of Ser. No. 07/603,138 filed Oct. 24, 1990, now abandoned.

FIELD OF THE INVENTION

This invention relates to machines for handling sheet materials such as paper. More particularly, this invention relates to means for controlling air flow in sheet material handling machines to avoid the movement of the material which can be caused by air flow.

BACKGROUND OF THE INVENTION

In various types of sheet material handling machines, such as in folders associated with printing presses, the material is mechanically coupled to a rotating cylinder which transports the material. For instance, in pin-type folders cut sheets are led through the folder by pins associated with the cylinder which pierce the leading edge of the sheets. Such pins do not always sufficiently control the transport of the cut sheets, and may permit the corners of the sheets to lift off the cylinder and fold back, creating a "dog-ear". Such a dog-ear problem may also occur in former folders, where the open edge of the signature is leading as it is held to a conveying cylinder by grippers.

In either type of machine, the cause of the problem is the same. When the open edge of a sheet or signature is led through the folder, it is transported rapidly through relatively stationary air. The air flow with respect to the paper tends to lift the paper from the cylinder. If the pins or grippers are not located very close to the corners of the sheets or signature, the corners may be lifted and folded back, and then creased to form a hard dog-ear when the cut sheets or signature run through the next cylinder nip.

In most circumstances there is little that can be done to reposition the pins or grippers relative to the corners of the sheets or signatures. Since the tendency to form dog-ears by the above mechanism is a function of machine speed as well as pin or gripper position, the most common solution is to reduce machine speed sufficiently to reduce dog-ear formation to an acceptable level. This is an undesirable solution, however, since it substantially affects production rates.

SUMMARY OF THE INVENTION

It is therefore an object of the invention to provide a method and apparatus for reducing formation of dog-ears in sheet material handling machines.

It is a further object of the invention to provide such a method and apparatus which does not require a reduction in machine speed.

It is a further object of the invention to provide such a method and apparatus which does not require repositioning of pins, grippers, or other material-holding devices.

It is a further object of the invention to provide such a method and apparatus which may be applied to existing machines as well as incorporated in new machines.

It is a further object of the invention to provide such a method and apparatus which is simple, rugged, reliable, and inexpensive.

In accordance with the foregoing objects, the method and apparatus of the invention includes providing air flow control means associated with a material-handling cylinder for controlling air flow with respect to the material so that the speed of the air impinging on the leading edge of the material, particularly at the corners, is reduced. The air flow control means is constructed so as to pass through the cylinder nip without adversely affecting machine operation. These and other objects and features of the invention will become apparent in view of the drawings and the following description.

DETAILED DESCRIPTION OF THE PREFERRED EMBODIMENT

Figure 1:
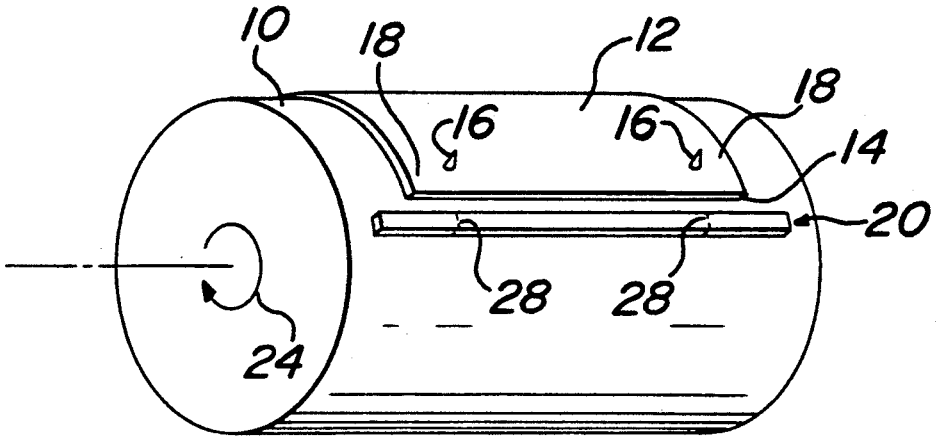
FIG. 1 is a perspective illustration of a pin-type cylinder embodying air-flow control means in accordance with the invention.

FIG. 1 shows in perspective a cylinder 10 used in sheet material handling machines such as paper folders. The cylinder 10 is mounted for rotation about its axis in the direction indicated by arrow 24, by means not shown, and carries a signature or sheets of material 12 such as paper. Material 12 is disposed along the surface of cylinder 10 in an orientation with an edge 14 of the sheet or sheets which is generally parallel to the axis of cylinder rotation and which is the leading edge of the material during rotation of cylinder 10. Cylinder 10 is rotated by means which are not shown. Cylinder 10 will generally be disposed adjacent a parallel cylinder, not shown, with the material conveyed through the nip thus formed.

The rotation of cylinder 10 carries the sheets or signature 12 rapidly through relatively still surrounding air, resulting in an air flow with respect to the leading edge 14 of the sheets or signature 12. Pins 16 which protrude from the cylinder 10 are provided, which pins 16 engage the material by piercing it near the leading edge 14 to secure it to the cylinder 10 during transport of the material. It is not always possible or practical to ensure that some of the pins 16 are located sufficiently close to the leading edge corners 18 of the material 12 that the air flow caused by cylinder rotation does not lift the corners and permit dog-ears to be formed. The same problem may occur in machines where the material engaging means includes grippers, for instance such as are shown in U.S. Pat. No. 4,501,415, which is incorporated herein by reference.

In accordance with the present invention, air flow control means is provided for directing the air flow relative to material 12, induced by cylinder rotation, away from the leading edge 14 of the material 12, whereby the speed of air impinging on the leading edge 14 and therefore its tendency to lift the material is reduced. As shown in FIG. 1, the air flow control means 20 is disposed along the surface of cylinder 10 and is displaced in the direction of cylinder rotation from the leading edge 14 of the material. FIG. 1 shows air flow control means 20 schematically, for the purpose of illustrating its location with respect to cylinder 10 and material 12.

Figure 2:
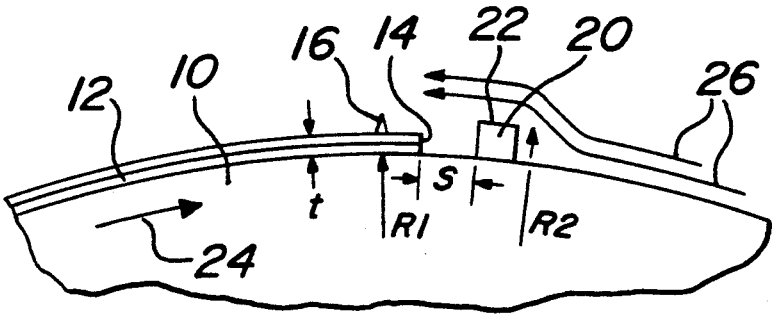
FIG. 2 is a view of a portion of the cylinder of FIG. 1, taken parallel to the axis of the cylinder, showing generally the operation of the air-flow control means of the present invention.

The operation of the air flow control means 22 is more clearly seen in FIG. 2, which is a schematic illustration of a portion of the apparatus of FIG. 1 in a direction parallel to the axis of cylinder rotation. The air flow control means comprises a portion 22 associated with cylinder 10 with an effective radius R2 with respect to the axis of cylinder rotation which is larger than the cylinder radius R1 with respect to the axis of cylinder rotation at the location of the leading edge 14 of material 12. Portion 22 will generally comprise one or more members affixed to the cylinder to provide it with an effective radius as specified; however, it will be understood that it may be fabricated as an integral part of cylinder 10. Air flow control means portion 20 is shown generally and schematically in FIG. 2; FIGS. 3–7 show particular structures suitable as air flow control means. In each of the figures, identical structures are indicated by common reference numbers.

Portion 20 is required to pass through the cylinder nip without interfering with machine operation. Accordingly, it may desirably have one of three types of structure and corresponding mode of operation.

Figure 3:
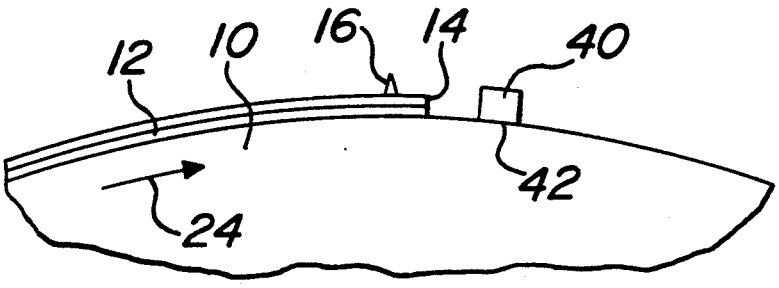
FIG. 3 is an axial illustration of a portion of a cylinder showing compressible resilient air flow control means.

In a first type of structure, portion 22 may provide the cylinder 10 with a radius R2 which is sufficiently large that portion 22 contacts the opposing cylinder when it passes through the nip. Air flow control means 20 is constructed of a compressible resilient material which is compressed as it passes through the nip and returns to its normal size when it emerges. This first type of air flow control means is illustrated in FIG. 3.

Figure 4:
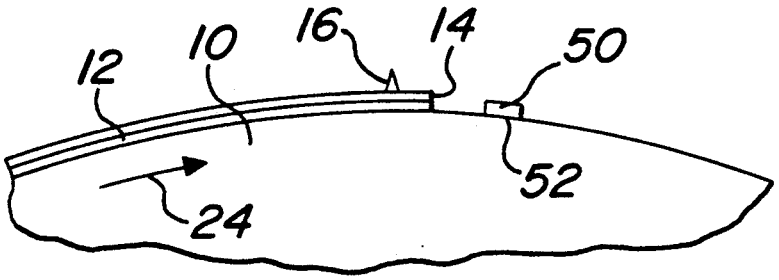
FIG. 4 is an axial illustration of a portion of a cylinder showing non-compressible, non-deflectable air flow control means.

In a second type of structure, portion 20 may provide the cylinder 10 with a radius R2 which is not sufficiently large to cause portion 20 to contact the opposing cylinder, in which case portion 20 will pass through the nip without interference regardless of its structure and composition. This second type of air flow control means is illustrated in FIG. 4.

Figure 7:
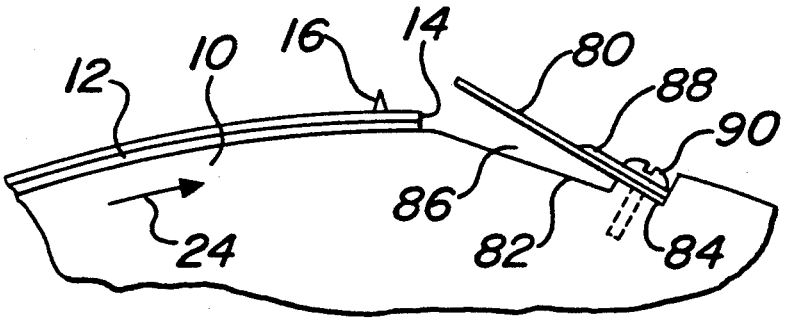
FIG. 7 is an axial illustration of a portion of a cylinder showing a third type of deflectable air flow control means.
Figure 5:
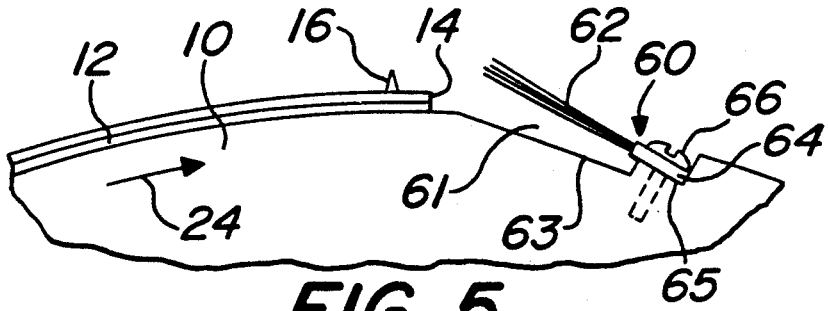
FIG. 5 is an axial illustration of a portion of a cylinder showing a first type of deflectable air flow control means.
Figure 6:
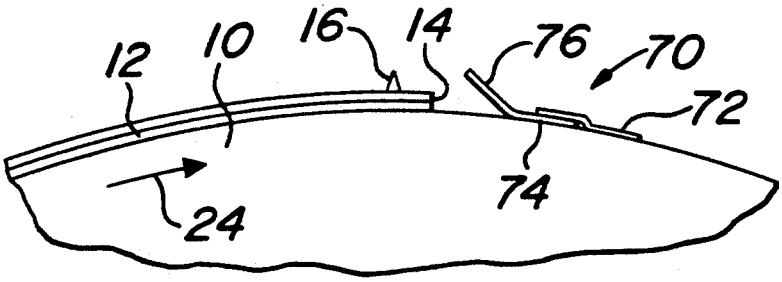
FIG. 6 is an axial illustration of a portion of a cylinder showing a second type of deflectable air flow control means.

In a third type of structure, portion 22 may provide the cylinder 10 with a radius R2 which is sufficiently large that portion 20 contacts the opposing cylinder as it passes through the nip, and air flow control means 20 includes a portion which is deflected upon contact with the opposing cylinder so that it will pass through the nip. Various embodiments of this third type of air flow control means is illustrated in FIGS. 5–7.

Other types of air flow control structures can also be provided which will pass through the nip, such mechanically retracted members, which in general are more complex and expensive than the preferred embodiments disclosed herein.

FIG. 2 shows schematically the operation air flow control means of the types described above. It should be understood that while the air flow control means is illustrated in FIG. 2 as generally rectangular in cross-section, and while a particular embodiment may desirably have such shape, such depiction is not intended to be limiting. A variety of shapes and structures may be used to advantage in accordance with the invention.

Air flow control means 20 controls air flow in the vicinity of the leading edge 14 of the material, deflecting the air flow relative to the material along the paths indicated by arrows 26. Rather than impinging directly upon the leading edge 14, flow along paths 26 includes a radial component caused by air flow control means 20 which causes the high velocity flow to pass over the leading edge 14 of the material and creates a region of relatively still air in the vicinity of the leading edge 14. Accordingly, the tendency of air flow to lift the leading edge 14 or leading edge corners 18 of the material is reduced, with a consequent reduction in dog-ears.

The air flow in the vicinity of the leading edge 14 of the material is influenced by the shape of air flow control means 20, by the radius R2 it provides to the cylinder, and by the separation S of portion 22 from the leading edge 14 along the circumference of the cylinder. Desirably portion 22 extends radially farther than the outer surface of the material 12, i.e., desirably R2 is greater than the sum of the cylinder radius R1 and the material thickness t. For instance, for a signature comprising sixteen sheets each of 0.003" thick material (total material thickness t=0.048"), portion 22 may extend beyond the cylinder surface by 0.25", i.e., R2=R1+0.25". It is believed that general, radial projection of portion 22 beyond the surface of cylinder 10 in the range of about 0.15"–0.35" will be adequate in most printing press applications and projection in the range of about 0.05"–50" will be adequate in virtually all such applications. It is desirable for portion 20 to be located as close as possible to the material leading edge 14 in a circumferential direction along the cylinder surface. In the foregoing example, a circumferential separation S between the material leading edge 14 and portion 22 of the air flow control means 20 of less than about 0.25" has been found acceptable.

Air flow control means 20 need not have a uniform cross-section at all points along the surface of cylinder 10 in the direction parallel to the cylinder axis. For instance, the problem of dog-ears is most acute at the leading edge corners 18 of the material, and thus the air flow control means may be configured to control air flow primarily at one or both leading edge corner 18. Thus, as shown in FIG. 1, the air flow control means 20 may comprise a pair of members 22 each disposed in the direction of cylinder rotation with respect to a leading edge corner 18 of the material 12, i.e., the portion of the illustrated strip of material between dotted lines 28 may be omitted. A pair of such members is desirably used when leading edge 14 is the open edge of a set of sheets of material, since both leading edge corners are then susceptible to lifting and forming dog-ears. However, if one of the leading edge corners 18 lies along a fold in a sheet or set of sheets of material, it may be possible to omit air flow control means associated with that corner and provide only one air flow control means circumferentially disposed in the direction of cylinder rotation from the non-folded leading edge corner 18. If the sheet material handling machine may be used at various times with materials of different widths or different folding configurations, it may simpler to provide air flow control means 20 which extends substantially along the entire length of the cylinder 10 which may contain material, so that the machine may be used without alteration for a variety of material widths and configurations of materials folding.

FIG. 3 shows an axial view of a portion of the cylinder of FIG. 1 in which the air flow control means is of the compressible resilient type. A compressible resilient member 40 is disposed along cylinder 10 in the direction of rotation from the leading edge 14 of material 12. Member 40 may for instance be constructed of foam rubber and may be secured to the cylinder by adhesive at 42. Member 40 compresses as it passes through the nip and returns to its uncompressed state when it emerges. Although member 40 is depicted as rectangular, it will be understood that other shapes may be provided. As shown, the radius of member 40 is greater than the sum of the cylinder radius and the material thickness. This is desirable, but not necessary, since the member 40 may otherwise still improve air flow.

FIG. 4 shows an axial view of a portion of the cylinder of FIG. 1 in which the air flow control means is of the non-compressible, non-deflectable type. A non-compressible, non-deflectable member 50 is disposed along cylinder 10 in the direction of rotation from the leading edge 14 of material 12. Member 50 may be constructed of steel, plastic, or virtually any other material since it provides the cylinder with a radius R2 which is small enough not to contact the opposing cylinder as it passes through the nip. In general, this requires that the radius R2 be less than the sum of the cylinder radius and the material thickness, and so this embodiment is less preferred in terms of air flow control. Member 50 may be affixed to the cylinder 10 such as by adhesive disposed at 52. Since compressibility and deflectability do not affect operation of a member 50 so dimensioned, member 50 of course may have these properties.

FIG. 5 shows an axial view of a portion of the cylinder of FIG. 1 including a first embodiment of air flow control means of the deflectable member type. In this embodiment, the deflectable member is a flat brush 60 which is mounted in a channel or recess 61 in the surface of cylinder 10. Bristles 62 of brush 60 protrude from the recess 61 beyond the cylinder surface to provide a radius R2 greater than the radius R1 of cylinder 10, thereby controlling air flow in the vicinity of the leading edge 14 of the material 12 adjacent to the bristle ends. The radially inwardmost portions of recess 61 are defined by a pair of surfaces 63 and 65. Surface 65 provides a mounting surface for mounting brush 60 which orients brush 60 so that the bristles 62 are properly disposed with respect to leading edge 14 in the radial and circumferential directions. Brush 60 is affixed to cylinder 10 at surface 65 in recess 61 by screw(s) 66. Recess 61 includes a portion defined by surface 63 to receive the bristles when they are deflected radially inwardly by contact with an opposing cylinder. Base 64 is dimensioned so as to pass through the nip without interference; the bristles 62 are deflected as they pass through the nip and return to their normal orientation as shown thereafter.

FIG. 6 shows an axial view of a portion of the cylinder of FIG. 1 having a second type of deflectable air flow control means. The deflectable member 70 is a piece of bendable material such as metal or plastic which includes a first portion 74 affixed to the cylinder 10 and a second portion 76 which projects radially away from the cylinder surface. As shown, member 70 is secured to cylinder 10 by a piece of adhesive-backed tape 72, one portion of which is adhered to portion 74 of member 70 and one portion of which is adhered to cylinder 10. When member 70 passes through the nip) portion 76 is deflected radially inwardly and returns to its normal shape thereafter. The thickness of member 70 and its securing means must be small enough to pass through the nip without interference if they are mounted to the surface of cylinder 10.

FIG. 7 shows another embodiment of deflectable type air flow control means. The embodiment of FIG. 7 is preferred in terms of long term reliability, but is more difficult to implement since it requires machining of cylinder 10 and provision of machined parts.

FIG. 7 includes a flexible member 80 which is mounted in a channel or recess 86 in the surface of cylinder 10. A portion of member 80 protrudes from the recess 86 beyond the cylinder surface to provide a radius R2 greater than the radius R1 of cylinder 10, thereby controlling air flow in the vicinity of the leading edge 14 of the material adjacent to it. The radially inwardmost portions of recess 86 are defined by a pair of surfaces 82 and 84. Surface 84 provides a mounting surface for mounting air flow control member 80 which orients member 80 so that its radially outermost edge is properly disposed with respect to leading edge 14 in the radial and circumferential directions. Member 80 is affixed to cylinder 10 at surface 84 in recess 86 by screw(s) 90. Recess 86 includes a portion defined by surface 82 to receive protruding portions of member 80 when member 80 is deflected radially inwardly by contact with an opposing cylinder. Support 88 controls movement of member 80 during its return to its undeflected position after member 80 has passed through the cylinder nip.

It will be understood that a variety of means may be provided for securing the air flow control means of FIGS. 3–7 to cylinder 10, and that the air flow control means may be affixed to the cylinder 10 in a variety of locations, to provide the air flow control described.

It is thus seen that air flow control means for a cylinder in a sheet material handling machine can control the flow of air in the vicinity of the leading edge of the material, particularly at the leading edge corners, so as to reduce the tendency to form dog-ears without reduction of machine speed. The methods and apparatus of the invention may be simply and inexpensively applied to existing or new machines. While particular embodiments of the invention have been shown and described, various modifications will no doubt occur to those skilled in the art which are embraced within the spirit of the invention and the scope of the following claims.

What is claimed is:

1. Apparatus for handling sheet materials comprising a cylinder rotatably mounted for movement about an axis of rotation, said cylinder including means for engaging at least one sheet of material adjacent an edge of said material which is generally parallel to said axis and is the leading edge of the material during cylinder rotation, said cylinder further including air flow control means for deflecting the air flow relative to said material which is induced by cylinder rotation away from said edge, whereby the tendency of said air flow to lift said material from said cylinder is reduced.

2. Apparatus according to claim 1, wherein said material engaging means includes pins adapted to pierce the material.

3. Apparatus according to claim 1, wherein said material engaging means includes grippers.

4. Apparatus according to claim 1, wherein said air flow control means comprises a compressible resilient material.

5. Apparatus according to claim 4, wherein said compressible resilient material is foam rubber.

6. Apparatus according to claim 1, wherein said air flow control means comprises a deflectable member.

7. Apparatus according to claim 6, wherein said deflectable member is made of metal.

8. Apparatus according to claim 6, wherein said deflectable member is made of plastic.

9. Apparatus according to claim 6, wherein said deflectable member comprises a brush.

10. Apparatus according to claim 1, wherein said air flow control means comprises a generally non-compressible, non-resilient member.

11. Apparatus according to claim 1, wherein said air flow control means comprises an air flow control member which is secured to said cylinder at the surface of said cylinder.

12. Apparatus according to claim 1, wherein said cylinder includes a recess formed in the surface of the cylinder, and said air flow control means includes an air flow control member which is secured to said cylinder in said recess.

13. Apparatus according to claim 1, wherein said air flow control means includes an air flow control member which is adhesively secured to said cylinder.

14. Apparatus according to claim 1, wherein said air flow control means controls the flow of air primarily near at least one corner of said leading edge of said material.

15. Apparatus according to claim 14, wherein said air flow control means controls the flow of air primarily near two corners of said leading edge of said material.

16. Apparatus for handling sheet materials comprising:

a cylinder rotatably mounted for movement about an axis of rotation, said cylinder including means for engaging at least one sheet of material adjacent an edge of said material which is generally parallel to said axis and which is the leading edge of the material during cylinder rotation, said cylinder having a radius R1 with respect to the axis of rotation at the leading edge of the material; and an air flow control member secured to said cylinder in the direction of cylinder rotation from said material leading edge, said air flow control member providing said cylinder with a radius R2 with respect to the axis of cylinder rotation which is greater than said cylinder radius R1.

17. Apparatus according to claim 16, wherein said material has a thickness t, and said radius R2 of said air flow control member is equal to or greater than about the sum of said cylinder radius R1 and said material thickness t.

18. Apparatus according to claim 16, wherein said air flow control member radius R2 is greater than said cylinder radius R1 by about 0.05 to about 0.50 inches.

19. Apparatus according to claim 18, wherein said air flow control member radius R2 is greater than said cylinder radius R1 by about 0.15 to about 0.35 inches.

20. Apparatus according to claim 16, wherein said material engaging means includes pins adapted to pierce the material.

21. Apparatus according to claim 16, wherein said material engaging means includes grippers.

22. Apparatus according to claim 16, wherein said air flow control member comprises a compressible resilient material.

23. Apparatus according to claim 22, wherein said compressible resilient material is foam rubber.

24. Apparatus according to claim 16, wherein said air flow control member comprises a deflectable member.

25. Apparatus according to claim 24, wherein said deflectable member is made of metal.

26. Apparatus according to claim 24, wherein said deflectable member is made of plastic.

27. Apparatus according to claim 24, wherein said deflectable member comprises a brush.

28. Apparatus according to claim 16, wherein said air flow control member comprises a generally non-compressible, non-resilient member.

29. Apparatus according to claim 16, wherein said air flow control member which is secured to said cylinder at the surface thereof.

30. Apparatus according to claim 16, wherein said cylinder includes a recess formed in the surface of the cylinder, and said air flow control member is secured to said cylinder in said recess.

31. Apparatus according to claim 16, wherein said air flow control member is adhesively secured to said cylinder.

32. Apparatus according to claim 16, wherein said air flow control member controls the flow of air primarily near at least one corner of said leading edge of said material.

33. Apparatus according to claim 16, wherein said air flow control member controls the flow of air primarily near two corners of said leading edge of said material.

34. A method of reducing the formation of dog-ears in sheet material handling machines which include a rotatably mounted cylinder and means for securing one or more sheets of material to said cylinder in an orientation with one edge of said sheet parallel to the axis of cylinder rotation to form the leading edge of said sheet during cylinder rotation, comprising controlling the air flow induced by cylinder rotation by radially deflecting said air flow near said material leading edge.

35. A method according to claim 34, wherein said air flow controlling step includes providing at least one air deflecting member disposed on said cylinder circumferentially in the direction cylinder rotation from said material leading edge.

36. A method according to claim 35, wherein said air deflecting member includes a compressible resilient member.

37. A method according to claim 35, wherein said air deflecting member includes a member which is deflectable radially inwardly in the direction of the axis of cylinder rotation.

38. A method according to claim 35, wherein said air deflecting member provides said cylinder with a radius R2 with respect to the axis of rotation which is greater than the radius R1 of said cylinder where said leading edge of said material is to be secured to said cylinder.

39. A method according to claim 35, wherein said air deflecting member provides said cylinder with a radius R2 with respect to the axis of rotation which is greater than about the sum of the radius R1 of said cylinder and the thickness of said material.

40. A method according to claim 35, wherein said deflecting step is performed primarily at one or more corners of said material leading edge.

41. A method according to claim 35, wherein said deflecting step is performed primarily at two corners of said material leading edge.

* * * * *

UNITED STATES PATENT AND TRADEMARK OFFICE

CERTIFICATE OF CORRECTION

PATENT NO. : 5,213,316

DATED : May 25, 1993

INVENTOR(S) : Michael H. Loebach

It is certified that error appears in the above-identified patent and that said Letters Patent is hereby corrected as shown below:

Title Page, Inventor, delete "Michael B. Loebach:, and substitute -- Michael H. Loebach -- therefor.

Signed and Sealed this

Fourth Day of January, 1994

*Attest:*

Bruce Lehman

BRUCE LEHMAN

*Attesting Officer*

*Commissioner of Patents and Trademarks*